US005797319A

United States Patent [19]

Tomczak

[11] Patent Number: 5,797,319

[45] Date of Patent: Aug. 25, 1998

[54] DRIVE DEVICE FOR A FOLDER IN A PRINTING PRESS

[75] Inventor: Charles Tomczak, Naperville, Ill.

[73] Assignee: Goss Graphic Systems, Inc., Westmont, Ill.

[21] Appl. No.: 891,742

[22] Filed: Jul. 14, 1997

Related U.S. Application Data

[63] Continuation-in-part of Ser. No. 530,559, Sep. 19, 1995, abandoned.

[51] Int. Cl.[6] ..... B41F 5/00; B41F 1/08

[52] U.S. Cl. ..... 101/216; 493/405; 493/424

[58] Field of Search ..... 101/411, 216; 270/4, 20.1, 21.1, 42, 50, 49; 493/356, 397, 405, 424, 425, 426, 427, 428, 429, 454

[56] References Cited

U.S. PATENT DOCUMENTS

| | | | |
|---|---|---|---|
| 1,826,601 | 10/1931 | Crafts . | |
| 1,865,696 | 7/1932 | Jordhoy . | |
| 1,900,288 | 2/1933 | Jordhoy . | |
| 1,997,126 | 4/1935 | Spillane | 270/50 |
| 2,016,486 | 10/1935 | Crafts | 270/50 |
| 3,038,719 | 6/1962 | Tyma, Jr. | 270/50 |
| 3,517,920 | 6/1970 | Snyder | 270/77 |
| 3,685,820 | 8/1972 | Surbrook | 270/76 |
| 3,865,361 | 2/1975 | Neal | 270/76 |
| 4,159,823 | 7/1979 | Bryer et al. | 270/21.1 |
| 4,190,242 | 2/1980 | Bolza-Schunemann | 270/50 |
| 4,226,149 | 10/1980 | Feldkamper et al. | 83/305 |
| 4,273,320 | 6/1981 | Fujishiro | 493/427 |
| 4,352,671 | 10/1982 | Petersen | 493/424 |
| 5,242,367 | 9/1993 | Marmin | 493/429 |
| 5,351,589 | 10/1994 | Creaden | 83/678 |
| 5,417,642 | 5/1995 | Boronka et al. | 493/425 |

*Primary Examiner*—Eugene H. Eickholt

*Attorney, Agent, or Firm*—Marshall, O'Toole, Gerstein, Murray & Borun

[57] ABSTRACT

A drive device (10) for a folder in a printing press having a folding blade mounted to a folding blade shaft (12). A drive gear (16) drives a folding blade shaft gear (14). The drive device also includes a plunger (24) having an intermediate gear (28) between the gear (14) of the folding blade shaft (12) and the drive gear (16), and a device for moving the plunger (24) between a first longitudinal position and a second longitudinal position. In the first longitudinal position, the intermediate gear (28) meshes with the folding blade shaft gear (14). In the second longitudinal position, the intermediate gear (28) is out of register with the drive gear (16) to prevent the folding blade shaft gear (14) from being driven by the drive gear 16. The drive device (10) may also include a cam (38) and an indexing ring (56) operable in response to axial movement of the plunger (24) to cause the intermediate gear (28) to be moved from the first longitudinal position to the second longitudinal position. The cam (38) and indexing ring (56) are designed to index or rotate in response to axial movement of the plunger (24). The drive device (10) may also include an interlocking tang (48) and a collar (50) to prevent the folding blade shaft (12) from rotating when the folding blade shaft (12) is not being driven.

11 Claims, 9 Drawing Sheets

DRIVE DEVICE FOR A FOLDER IN A PRINTING PRESS

This is a Continuation-In-Part of application Ser. No. 08/530,559 filed on Sep. 19, 1995 and now abandoned.

BACKGROUND OF THE INVENTION

The present invention relates to a drive device for a folder in a printing press.

In order to increase a product's page count, folders in a printing press utilize a method of collecting sheets to become a larger product. To accomplish this task, a folding blade is silenced so that it does not perform a tucking operation into nipping rollers. This action, which occurs in collect mode, permits the product to remain on a folding cylinder so that it is supplemented with additional sheets as a result of the folding cylinder rotating another revolution. This action is in contrast to the straight mode during which no folding blades are silent and no products are permitted to remain on the cylinder. The switch from collect mode to straight mode or vice versa is called a changeover. A step-by-step description of the straight and collect modes is illustrated in FIG. 1.

A typical folding assembly comprises a cutting cylinder that cuts the paper into product lengths and a folding cylinder with a folding blade drive. In typical folding assemblies, such as U.S. Pat. No. 3,038,719 to Tyma and U.S. Pat. No. 4,273,320 to Fujishiro, in order to silence the folding blade or reactivate the folding blade from a silenced condition, a number of steps must be performed. These steps include: accurately positioning a socket located in the folding cylinder, inserting a wrench or similar tool in the socket, rotating the wrench (or pushing and rotating the wrench), and retracting the wrench.

SUMMARY OF THE INVENTION

The above disadvantages are overcome by a folder in accordance with the present invention. A principal feature of the present invention is the provision of a drive device for a folder in a printing press.

One embodiment of a folder in accordance with the present invention comprises a folding blade mounted to a folding blade shaft, a folding blade shaft gear mounted to the folding blade shaft for driving the folding blade, a drive gear for driving the folding blade shaft gear, and coupling means for coupling the drive gear to the folding blade shaft gear.

The coupling means includes an intermediate gear and is slidable between a first longitudinal position and a second longitudinal position. The coupling means engages the drive gear to the folding blade shaft gear while the coupling means is in the first longitudinal position. The folder also comprises means for biasing the engaging means in the first longitudinal position. The intermediate gear meshes with the folding blade shaft gear and the drive gear to drive the folding blade shaft while the coupling means is in the first longitudinal position, and the intermediate gear is out of mesh with the drive gear to prevent the drive gear from driving the folding blade shaft gear while the coupling means is in the second longitudinal position.

The coupling means may include a plunger. The biasing means may include a spring.

Another embodiment of the present invention comprises a folding blade mounted to a folding blade shaft, a folding blade shaft gear mounted to the folding blade shaft for driving the folding blade, a drive gear for driving the folding blade shaft gear, and a plunger having a pin and having an intermediate gear between the folding blade shaft gear and the drive gear. The device also comprises means for biasing the plunger in a first longitudinal direction, particularly in the form of a spring, and cam means having a cam race comprising first and second stops.

The plunger is in a first longitudinal position when the plunger pin is slidably engaged in the first stop. The plunger is in a second longitudinal position when the plunger pin is slidably engaged in the second stop. The intermediate gear meshes with the folding blade shaft gear and the drive gear to drive the folding blade shaft while the plunger is in the first longitudinal position, and the intermediate gear is out of mesh with the drive gear while the plunger is in the second longitudinal position to prevent the drive gear from driving the folding blade shaft gear.

In a further respect, the drive gear has a central recess formed between a pair of sets of opposed spaced teeth, and the intermediate gear also has a central recess formed between a pair of sets of opposed teeth. One of the sets of teeth of the drive gear is located in the central recess of the intermediate gear while the plunger is in the second longitudinal position and, likewise, one of the sets of teeth of the intermediate gear is located in the central recess of the drive gear while the plunger is in the second longitudinal position. In other words, the respective sets of teeth of the drive gear and the intermediate gear are longitudinally shifted relative to one another so as to be out of engagement when the plunger is in the second longitudinal position.

The folder of the present invention may comprise a tang mounted on the plunger to prevent rotation of the folding blade when the plunger is in the second longitudinal position. Also, the folder of the present invention may include actuating means for moving the plunger in a second longitudinal direction against the biasing force of the spring, preferably in the form of a retractable wedge.

In yet another respect, the folder includes an indexing ring mounted on the plunger for rotation with respect to the plunger. The plunger pin may slidably engage the indexing ring during movement of the plunger in the second longitudinal direction against the biasing force of the spring to cause the cam means to rotate with respect to the plunger.

Another feature of the invention is that the drive gear drives the folding blade shaft while the plunger is in the first longitudinal position and prevents the drive gear from driving the gear of the folding blade shaft while the plunger is in the second longitudinal position.

Thus, a feature of the invention is that the device has an "on" and "off" drive condition for the folding blade shaft in which the drive gear is either indirectly engaged or disengaged from the gear of the folding blade shaft through the intermediate gear.

Another feature of the invention is that the device of the present invention is of simplified construction and reduced cost.

A further feature of the invention is the provision of means for releasably locking the intermediate gear out of engagement with the drive gear while the plunger is in the second longitudinal position thereby preventing the folding blade from accidentally rotating.

A feature of one embodiment of the present invention is cam actuation of the plunger to shift the intermediate gear from the straight mode to collect mode and vice versa. This cam operation eliminates the above-described steps required for the changeover from straight mode to collect mode in conventional folding assemblies. Because the prime mover is a "push-retract" force, the plunger is axially moved against the biasing force of the spring by means external to the folding cylinder such as a retractable wedge or the hand of an operator.

The device may include means for releasably retaining the plunger in the first and second longitudinal positions.

It is readily apparent that the present invention offers advantages over conventional drive devices. The capability of automatic straight/collect changeover is one advantage. Other advantages include the positioning of the gear train for straight mode drive or collect mode drive and the prevention of folding blade rotation in the collect mode.

Further features will become more fully apparent in the following description of the embodiments of the invention, and from the appended claims.

DESCRIPTION OF THE PREFERRED EMBODIMENTS

Figure 1:
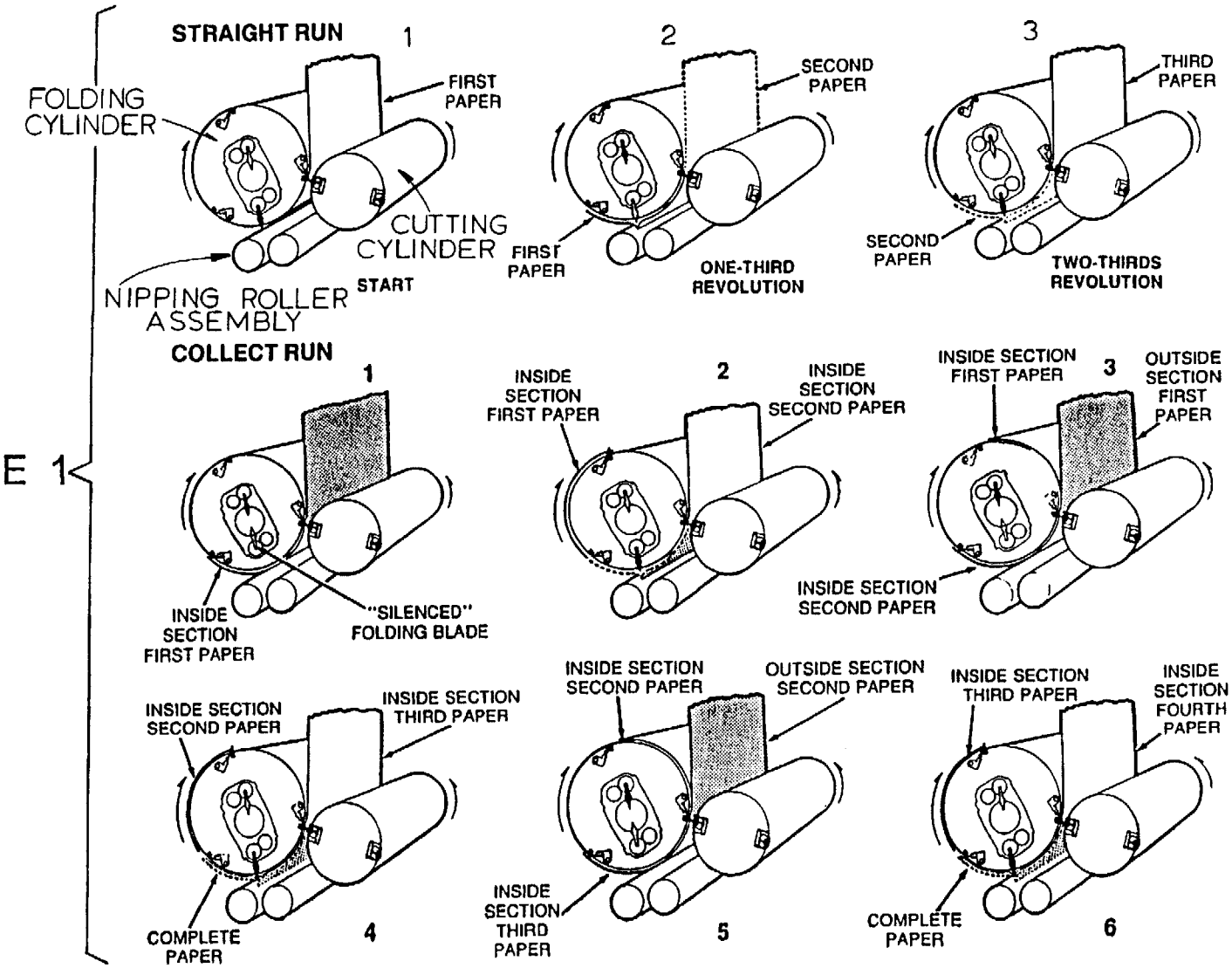
FIG. 1 is a step-by-step description of the straight and collect operations of a folder in a printing press.

FIG. 1 gives a step-by-step description of the straight and collect operations of a typical rotary newsprint folder of a printing press. In the drawings, a 3/2 folder is featured (3/2 means the collect or folding cylinder is sized diametrically 3 cutoff lengths of newsprint and the cutting cylinder is sized 2 cutoff lengths of newsprint). Various ratios of folding cylinder to cutting cylinder can also be used, i.e., 5/2.

Straight Run

The first caption of FIG. 1 shows the paper being pulled by the folding cylinder. Note that a 2-folding blade mechanism is featured; it rotates at a speed of 3/2 times the folding cylinder.

The second caption shows the first paper pulled around the folding cylinder to a precise point whereupon the cutting cylinder, which is timed to the folding cylinder, severs the first paper from the second paper. Immediately following the cutting operation, the first paper is tucked into a nipping roller assembly. The second paper is held to the folding cylinder via pins located on the folding cylinder.

The third caption is a repeat operation of the second caption except that the second paper is being tucked into the nipping roller assembly. During the straight operation, every paper is tucked into the nipping roller assembly. Therefore, each folding blade shaft is engaged with the drive gear.

Collect Run

The collect operation differs from the straight operation because every other paper is tucked into the nipping roller assembly. Those papers which are not tucked, initially, remain with the folding cylinder and are joined with another paper before being tucked into the nipping roller assembly.

During the collect operation, one folding blade shaft is disengaged from the drive gear (silenced) to prevent the paper from being tucked into the nipping roller assembly.

Still referring to FIG. 1, in the first caption, the inside section of the first paper is in the tucking position, but the folding blade is silenced, and the folding cylinder pins remain extended into the paper. The cutting cylinder severs the first paper's inside section from the succeeding paper's outside section.

The second caption shows the first paper's inside section remaining with the folding cylinder, and the succeeding outside section being tucked into the nipping roller assembly. The tucked paper will have no inside section so it will be discounted as waste. The silenced folding blade shaft has rotated 180 degrees, and the engaged folding blade assembly creates the tucking action.

The third caption shows the first paper's inside section remaining on the folding cylinder, and it is being joined by the outside section. Meanwhile, the inside section of the second paper is not tucked into the nipping roller assembly because the engaged folding blade assembly has rotated 180 degrees, and the silenced folding blade assembly is in the tucking position.

The fourth caption gives a picture of the first complete paper being tucked into the nipping roller assembly because the silenced folding blade assembly has rotated 180 degrees, and the engaged folding blade assembly is in the tucking position. Simultaneously, the second paper's inside section remains with the folding cylinder, and the third paper's inside section is being pinned onto the folding cylinder. Note that caption 4 is identical to caption 2.

The fifth caption is identical to the third caption except that the second paper is receiving the outside section. Likewise, the sixth caption is identical to the fourth caption except that the second complete paper is being tucked into the nipping roller assembly.

The operation keeps repeating with every other complete paper (i.e., inside and outside sections) being tucked into the nipping roller assembly. The drive device in the present application controls the action (engaged or silenced) of the folding blade assemblies of which the folding blade shafts are a part and to which shafts the folding blades are attached.

In the newsprint industry, the printing unit may be 2 cutoffs around whereupon the newsprint web will have alternating printed images. Since the folding cylinder is of an odd integer cutoff (3, 5, 7, etc.), each inside section will be joined with a different outside section (i.e., B will be joined with A).

Figure 1A:
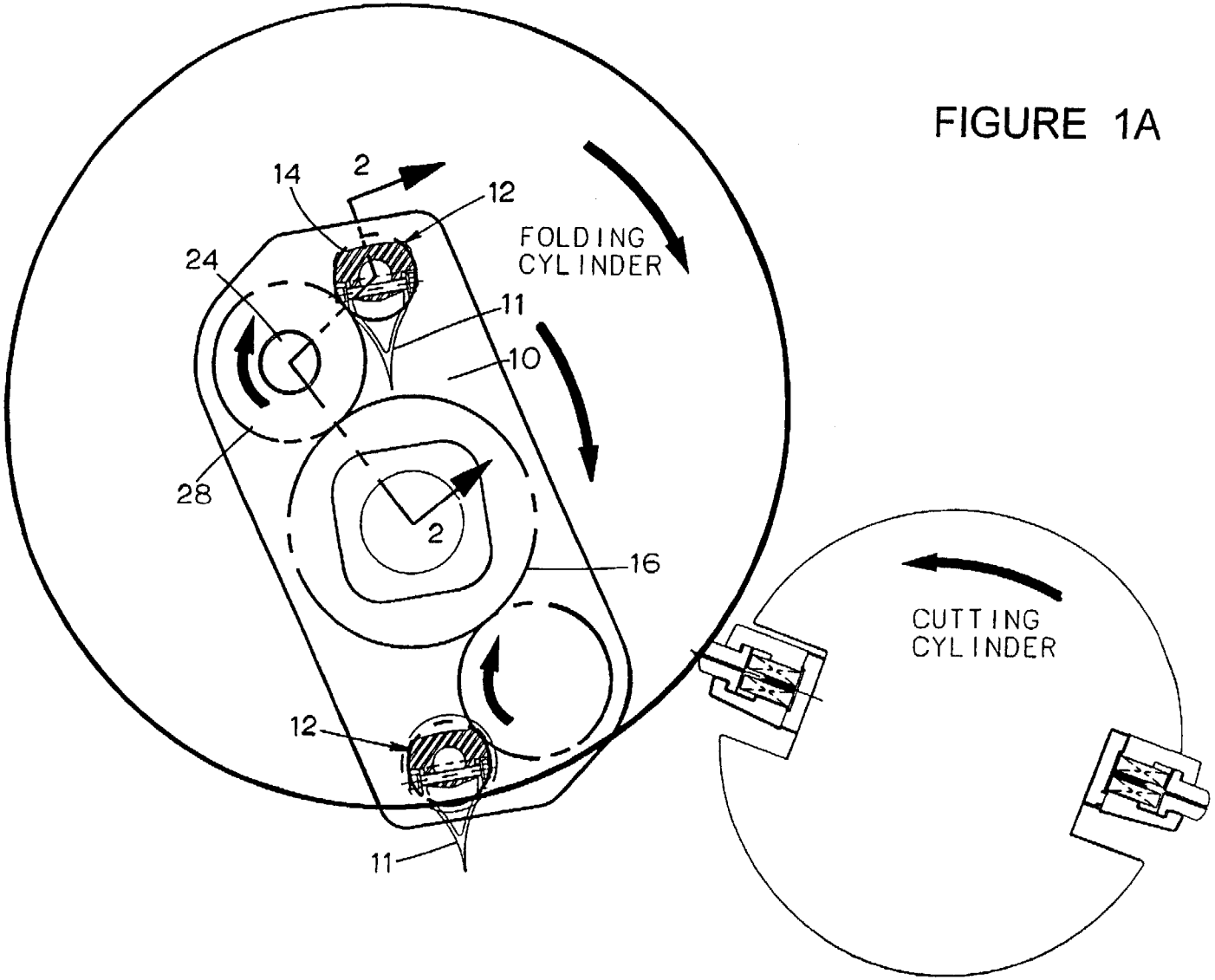
FIG. 1A is a side elevational view of a rotary folder cutting and folding cylinder assembly according to the present invention.

FIG. 1A is a closeup illustration of a cutting cylinder and a folding cylinder having a folding blade drive 10. Referring to FIGS. 2–5, there is shown a step-by-step description of the changeover mechanism in operation as the folding blade assembly moves from straight mode to collect mode. The drive device 10 has a rotating folding blade 11 which is mounted on a folding blade shaft 12. The folding blade shaft 12 has an outer gear 14 for driving the folding blade shaft 12.

The drive device 10 has a drive gear 16 aligned with the folding blade shaft gear 14 on the folding blade shaft 12. The drive gear 16 has a central recess 18 defining teeth 20 on one side of the central recess 18, and teeth 22 on the other side of the central recess 18.

FIG. 1A shows the relationship of the folding blade shaft gear 14 and the drive gear 16. In this invention, the drive gear 16 is motionless with respect to the ground (i.e., the drive gear 16 does not rotate around its own longitudinal axis) and, as the drive device 10 rotates clockwise, the folding blade shaft gear 14 rotates clockwise with respect to the drive gear 16 but rotates counterclockwise with respect to an axis extending through the folding blade shaft gear 14.

Figure 2:
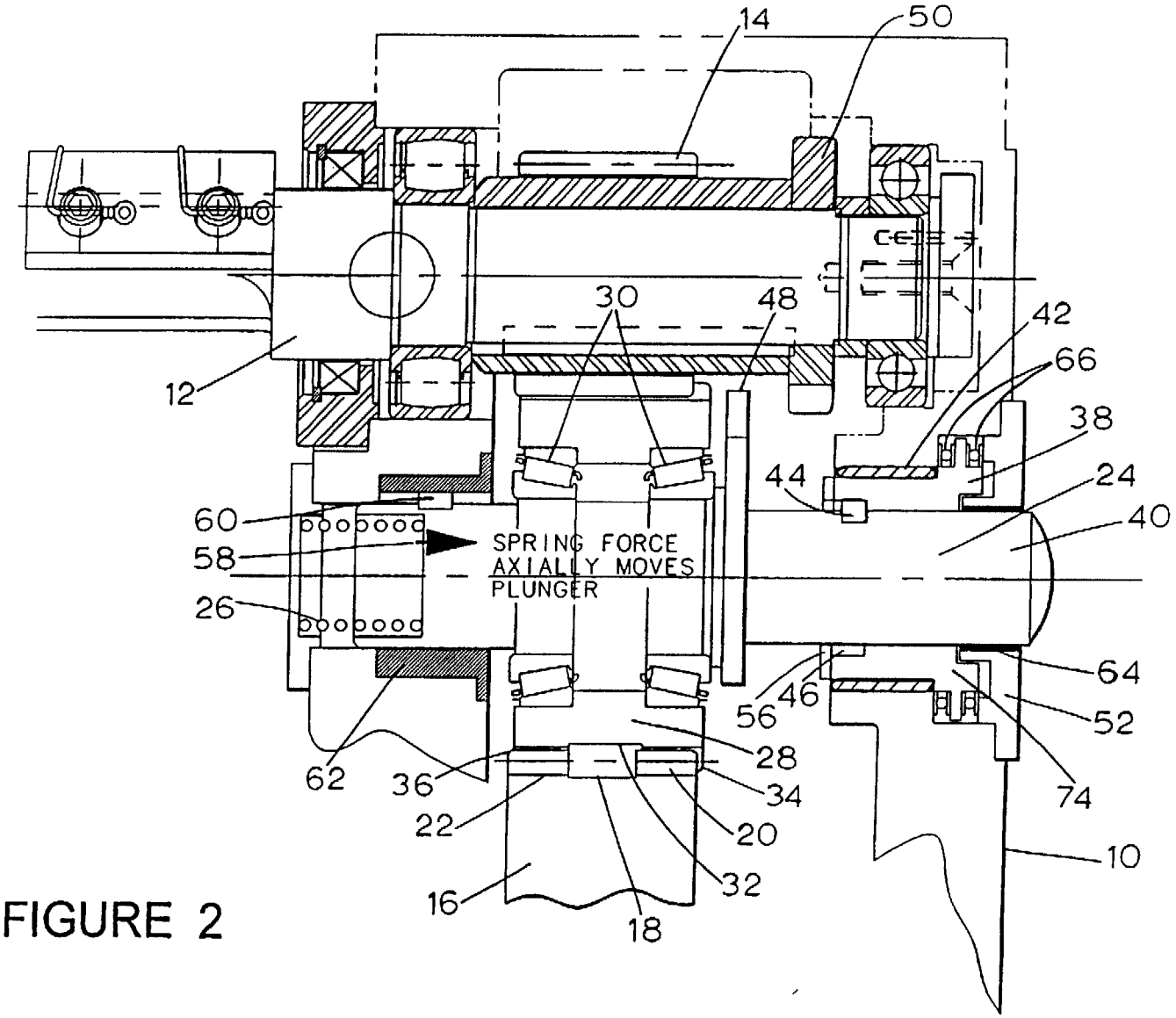
FIG. 2 is a sectional view of a device for driving a folding blade shaft taken along line 2—2 of FIG. 1A and showing indirect engagement of the folding blade shaft with a drive gear and showing a cam and a spring for positioning the intermediate gear.

Referring to FIGS. 2–6, the drive device has an elongated plunger 24 which is slidably mounted in the drive device 10, and which is outwardly biased by a helical spring 26. The plunger 24 has an intermediate gear 28 which is rotatably mounted on the plunger 24 by bearings 30. In the configuration of FIG. 2, the intermediate gear 28 is meshed with the drive gear 16, and with the folding blade shaft gear 14 in order to rotatably drive the folding blade shaft gear 14 and the folding blade shaft 12 by the intermediate gear 28. The intermediate gear 28 has a central recess 32 defining teeth 34 on one side of the central recess 32, and teeth 36 on the other side of the central recess 32.

A cam 38 is mounted on an outer end portion 40 of the plunger 24 by a bearing 42. A pin 44 extending from the plunger 24 is received in a cam race 46 of the cam 38. An indexing ring 56 having teeth 76 (FIG. 6) is mounted on the plunger 24 for rotation with respect to the plunger 24. The indexing ring 56 may be attached to the cam 38 by a brace (not shown) that is arched away from the plunger 24 so that the brace does not interfere with the pin 44 as the arch rotates around the plunger 24 with the indexing ring 56.

A housing 74 encases the cam 38 and the indexing ring 56. The housing 74 may anchor the cam 38 with respect to the indexing ring 56 so that the cam 38 and the indexing ring 56 do not move either axially or rotationally with respect to each other. For example, the housing 74 may be glued or otherwise fastened to the cam 38 or to the indexing ring 56. Alternatively, either the cam 38 or the indexing ring 56 may be integral with the housing 74, as shown in FIG. 2. As will be discussed in more detail below, the indexing ring 56 rotates the cam 38 when the indexing ring 56 is rotated by axial movement of the pin 44 caused by moving the plunger 24 in a direction against a biasing force 58 of the helical spring 26. Return axial movement of the plunger 24 will be provided by the return force 58 of the helical spring 26.

The plunger 24 is slidably supported by a rear bearing 62 and a front bearing 64. The plunger 24 also has a key 60 which slides in the rear bearing 62 during axial movement of the plunger 24 for the changeover operations and prevents the plunger 24 from rotating about its axis. A cap 52 holds the cam 38 in position in the drive device 10. Thrust bearings 66 are disposed on the cam 38 adjacent the bearing 42. The thrust bearings 66 facilitate cam 38 rotation as does the bearing 42. With the pin 44 pushing against the cam 38 by reason of the biasing force 58 of the helical spring 26, the thrust against the drive device 10 or the cap 52 is minimized by the thrust bearings 66. A bushing or similar structure may be use in place of the thrust bearings 66.

The plunger 24 is movable from a first longitudinal position (straight mode shown in FIG. 2) with the gears 14, 28, and 16 being meshed, to a second longitudinal position (collect mode shown in FIG. 4) wherein the intermediate gear 28 is moved outwardly in the drive device 10. In the second longitudinal position, the cam 38 releasably retains the plunger 24 in this position such that the teeth 36 of the intermediate gear 28 are received in the central recess 18 of the drive gear 16, and the teeth 20 of the drive gear 16 are received in the central recess 32 of the intermediate gear 28. In this configuration, the drive gear 16 no longer causes the folding blade shaft gear 14 to be driven since the drive gear 16 and the folding blade shaft gear 14 are no longer meshed with the intermediate gear 28. And further, a tang 48 mounted on the plunger 24 preferably engages a collar 50 of the folding blade shaft 12 to prevent rotation of the folding blade shaft 12.

Figure 4:
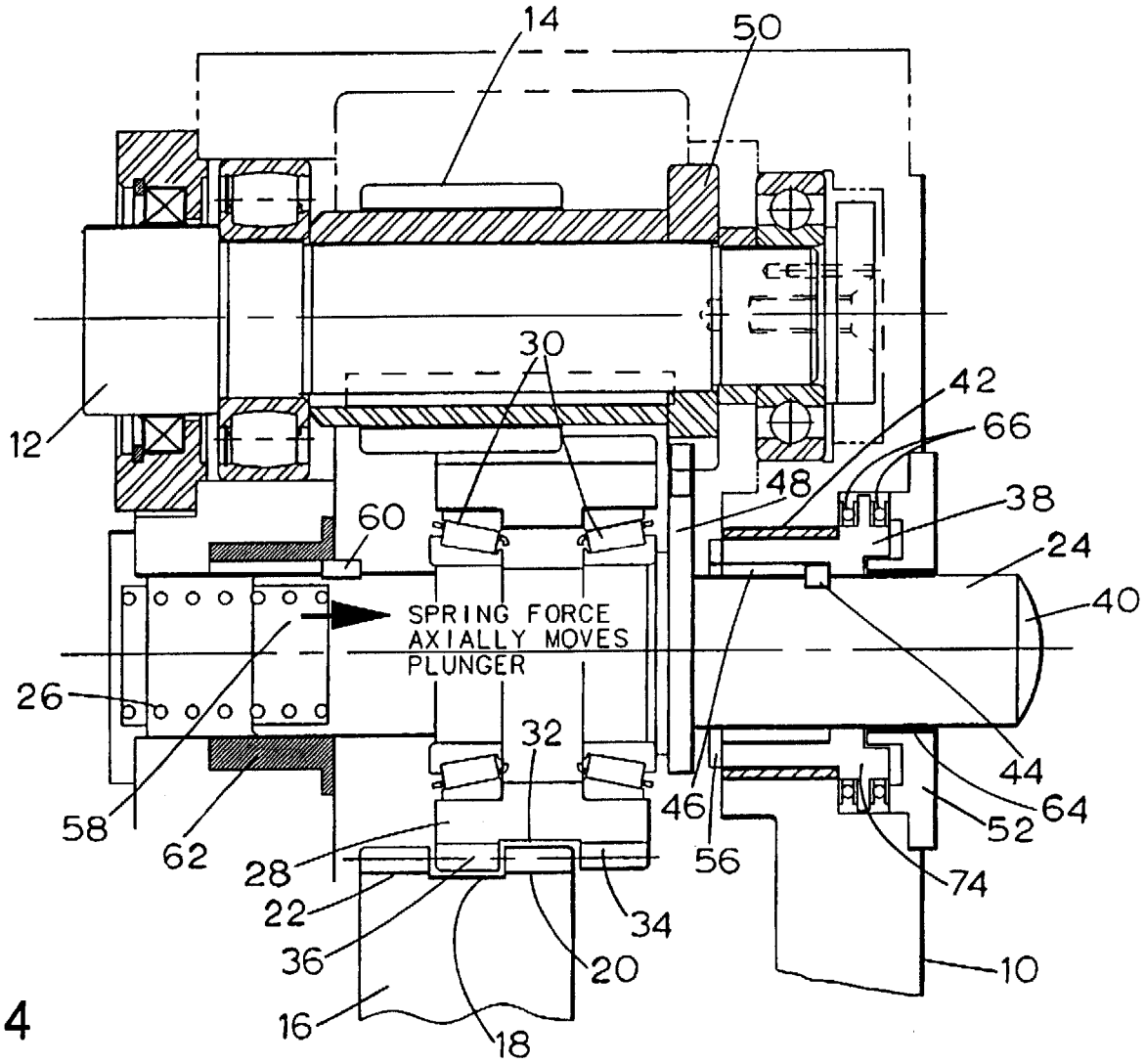
FIG. 4 is a sectional view of the drive device of FIG. 2 showing the drive gear indirectly disengaged from the folding blade shaft and showing a tang.

The outer end portion 40 of the plunger 24 is engaged by an actuating member 53 (FIG. 8) providing an actuating force 54 in order to move the plunger 24 from the first longitudinal position of FIG. 2 to the second longitudinal position shown in FIG. 4 (and vice versa). In other words, the outer end portion 40 of the plunger 24 may later be actuated again by providing an actuating force 54 with the actuating member 53 to move the plunger 24 from the second longitudinal position of FIG. 4 to the first longitudinal position shown in FIG. 2. In each instance, after the actuating force 54 provided by the actuating member 53 has been applied, the spring 26 moves the plunger 24 to the respective first and second longitudinal positions (shown in FIGS. 2 and 4) with the intermediate gear 28 engaged and disengaged with the drive gear 16 in order to drive and silence the folding blade shaft 12 in the respective straight and collect modes of operation.

When performing a changeover from the collect to straight mode of operation, the plunger 24 is moved from its second to first longitudinal position, and the cam 38 is rotated by the pin 44 as it engages one of the teeth 76 of the indexing ring 56. The plunger 24 is then released and the helical spring 26 causes it to be biased outwardly so as to cause the pin 44 to engage the cam race 46 to further rotate the cam 38 to a position in which the plunger 24 will be retained in the first longitudinal position. Thus, in this manner, the plunger 24 is pushed each time it is desirable to change the configuration or relative relationship of the gears 14, 16, and 28 such that the drive device 10 controls the engagement of the gears to drive the folding blade shaft 12 and disengagement of the gears to stop rotation of the folding blade shaft 12. Operation of the cam 38 and the actuating member 53 are discussed in more detail below.

Figure 6:
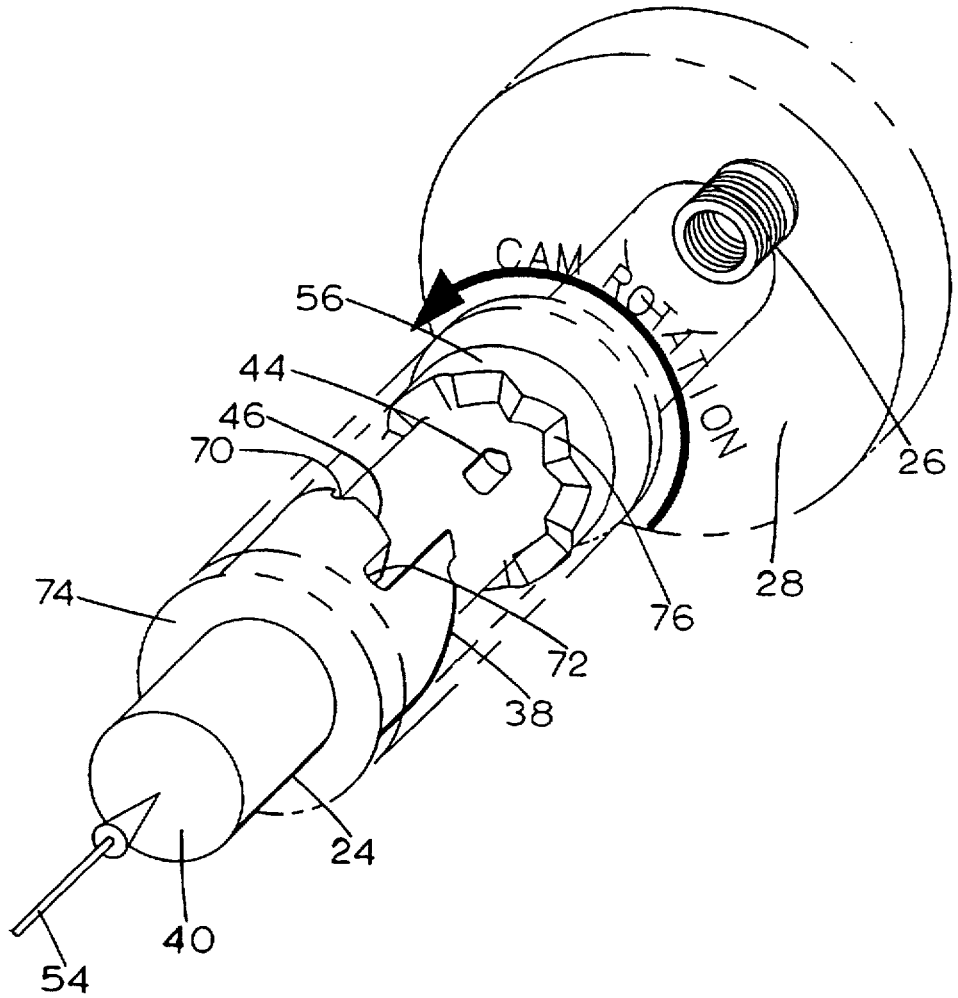
FIG. 6 is an isometric view of the cam of FIG. 2 with portions of the cam housing broken away to reveal detail.
Figure 7A:
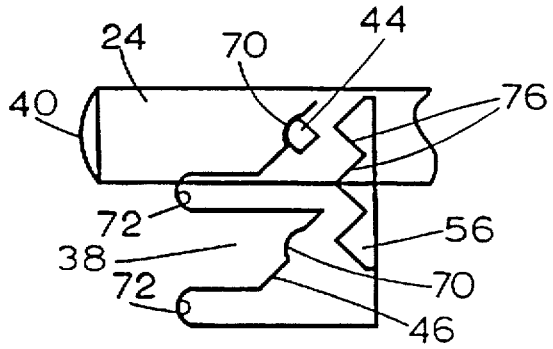
FIG. 7 is a step-by-step diagram showing the relationship of cam rotation to plunger movement and a spring force with the cam mapped flat for clarity.
Figure 7B:
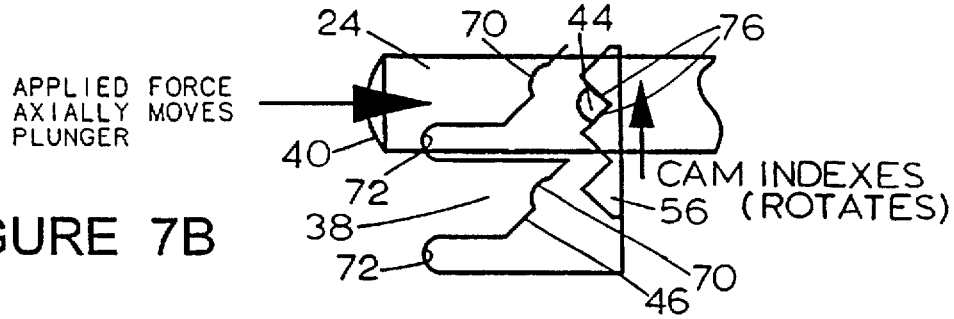
Figure 7C:
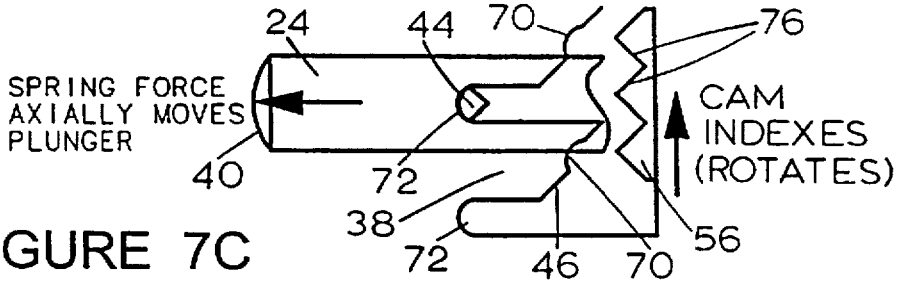
Figure 7D:
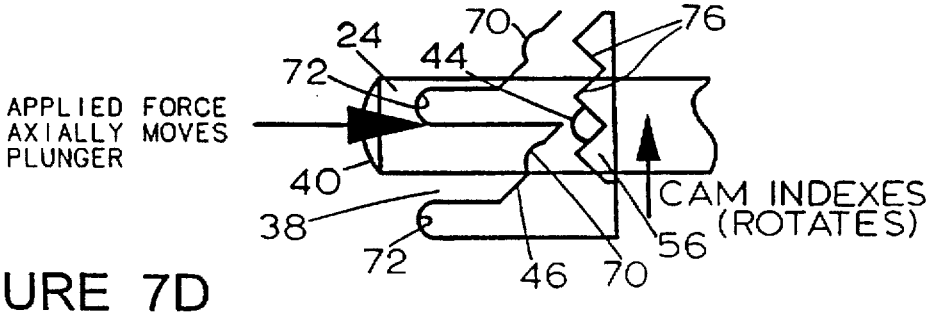

During outward axial movement of the plunger 24 caused by the helical spring 26, the cam race 46 is contacted by the pin 44 causing the cam 38 to index or rotate. Rotation of the cam 38 permits further outward axial translation of the plunger 24, because the pin 44 slidably engages different portions of the cam race 46 as the cam 38 continues to rotate. More particularly, as seen in FIG. 6, the cam race 46 has curves that undulate longitudinally with respect to the plunger 24. The curves of the cam race 46 define a first stop 70 for the pin 44 at a first longitudinal position with respect to the cam 38 and define a second stop 72 for the pin 44 at a second longitudinal position with respect to the cam 38.

The longitudinal position of the plunger 24 varies as the pin 44 moves from the first stop 70 to the second stop 72 and vice versa. The pin 44 slidably and releasably engages the first and second stops 70, 72.

The first stop 70 in the cam race 46 corresponds to the plunger 24 being in the first longitudinal position. The second stop 72 in the cam race 46 corresponds to the plunger 24 being in the second longitudinal position. Thus, in FIG. 4, in which the folding cylinder is in collect mode and the plunger 24 is in the second longitudinal position, the pin 44 is in the second stop 72. The position of the pin 44 is more clearly shown in FIG. 7C. As seen in FIGS. 6 and 7, the cam race 46 may define a plurality of the first stops 70 and the second stops 72.

Figure 3:
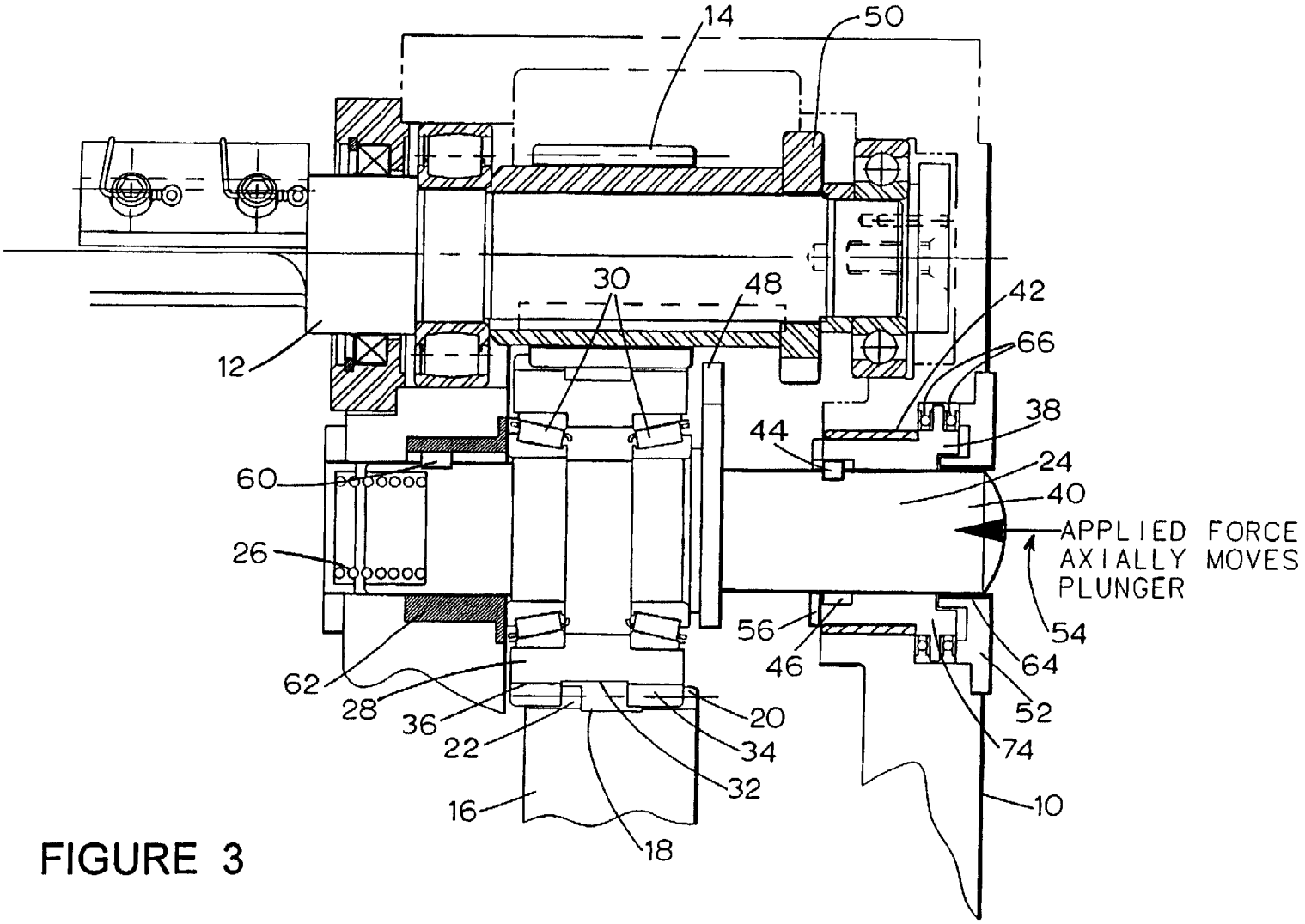
FIG. 3 is a sectional view of the drive device of FIG. 2 showing a force being applied to the plunger so as to initiate the changeover operation from straight mode to collect mode.

FIG. 3 shows the outer end portion 40 of the plunger 24 being urged by the actuating force 54 in order to move the plunger 24 longitudinally inward so that the pin 44 contacts the teeth 76 (FIG. 6) of the indexing ring 56 causing the cam 38 to index or rotate. Upon release of the plunger 24 from the actuating force 54, the force 58 provided by the helical spring 26 axially moves the plunger 24 outward causing the pin 44 to contact the cam race 46 resulting in the cam 38 further indexing or rotating. As the cam 38 completes this indexing or rotation cycle, the pin 44 and the plunger 24 move axially, first inwardly and then outwardly, until the pin 44 is disengaged from one of the first stops 70 and is then slidably engaged with one of the second stops 72. The net axial translation of the plunger 24 as the pin 44 moves from one of the first stops 70 to one of the second stops 72 allows the plunger 24 (and thus the intermediate gear 28) to move to the second longitudinal position (i.e., collect mode) from the first longitudinal position (i.e., straight mode).

FIG. 4 shows the plunger 24 in the second longitudinal position (i.e., collect mode) following release of the plunger 24 from the actuating force 54 and following outward axial movement resulting from the force 58 produced by the helical spring 26. The tang 48 is in position to prevent rotation of the folding blade shaft 12 by interlocking with the collar 50.

Figure 5:
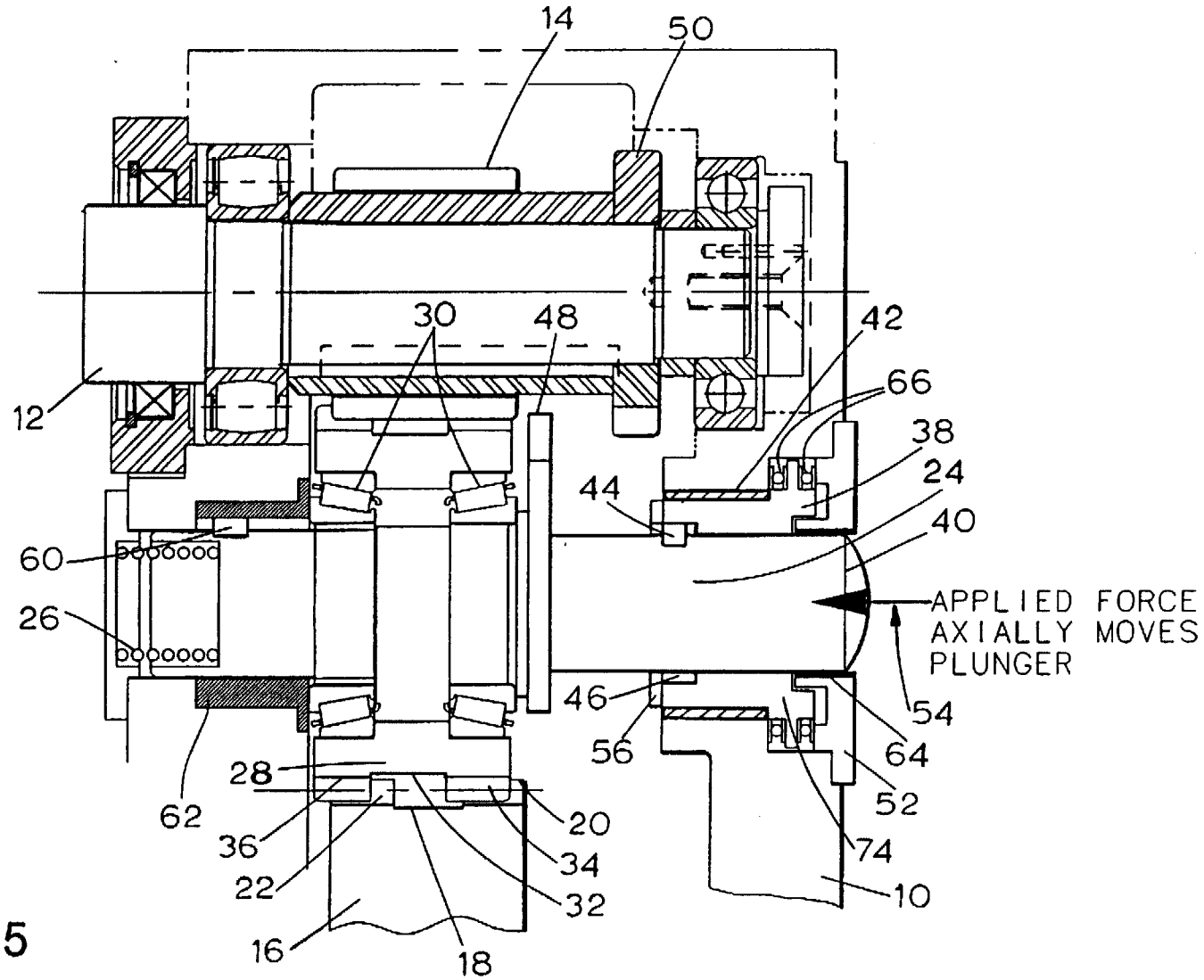
FIG. 5 is a sectional view of the drive device of FIG. 2 showing a force being applied to the plunger so as to initiate the changeover operation from collect mode to straight mode.

FIG. 5 shows the outer end portion 40 of the plunger 24 being urged by the actuating force 54 in order to move the plunger 24 inward so that the pin 44 contacts the teeth 76 (FIG. 6) of the indexing ring 56 causing the indexing ring 56 to index or rotate. Upon release of the plunger 24 from the actuating force 54, the force 58 generated by the helical spring 26 axially moves the plunger 24 outward causing the pin 44 to contact the cam race 46 resulting in the cam 38 indexing or rotating. As the cam 38 completes this indexing or rotation cycle, the pin 44 and the plunger 24 move axially, first inwardly and then outwardly, until the pin 44 is disengaged from one of the second stops 72 and is then once again slidably engaged to one of the first stops 70. The net axial translation of the plunger 24 as the pin 44 moves from one of the second stops 72 to one of the first stops 70 allows the plunger 24 (and thus the intermediate gear 28) to return to the first longitudinal position (i.e., straight mode) from the second longitudinal position (i.e., collect mode).

FIG. 7 is a step-by-step illustration of the indexing or rotational movement produced by reason of the relationship between the indexing ring 56 and the cam 38 as caused by the axial movement of the plunger 24 and the pin 44. For clarity, the cam 38 including the cam race 46, and the indexing ring 56 are shown flat, and FIGS. 7A–7D correspond to previously described FIGS. 2–5, respectively.

Figure 8:
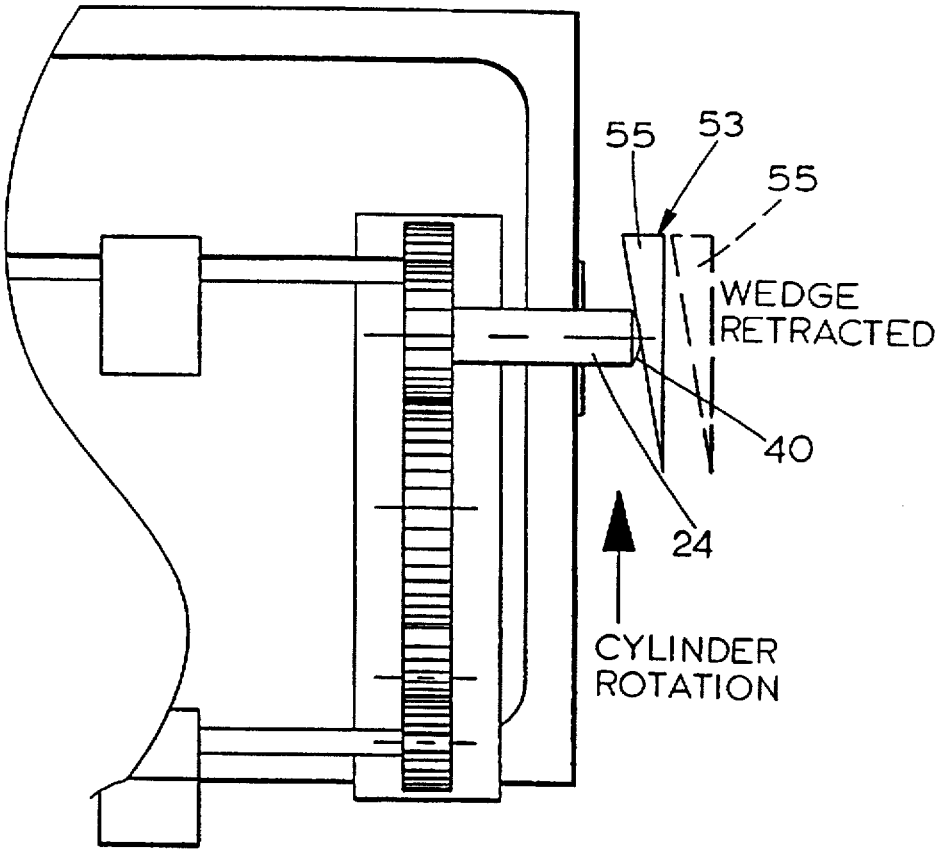
FIG. 8 is a side elevational view of one structure for supplying a force to actuate the changeover operation, the folding cylinder being shown with portions broken away to reveal detail inside.

FIG. 8 is an illustration of one embodiment of the actuating member 53 for applying a force 54 to the plunger 24 and how, upon the folding cylinder's rotation, the plunger 24 would be urged by the actuation force 54. The structure shown in FIG. 8 for applying the force 54 is a wedge 55 which can be retracted, such as by pneumatic means, so that the wedge 55 does not apply the force 54 to the plunger 24 during the folding cylinder's rotation. Another suitable structure for applying the force 54 would be a retractable shaft or a ram coaxial with and external to the plunger 24 or, alternatively, an operator could manually apply the force 54 to the plunger 24 when the folding cylinder is not rotating.

Thus, as shown in FIGS. 2–5, the plunger 24 is pushed inwardly and then released each time it is desirable to change the configuration or relationship of the gears 14, 28, and 16 to either drive the folding blade shaft 12 by meshing those gears or stop the rotation of the folding blade shaft 12 by disengagement of those gears.

The foregoing detailed description has been given for clarity of understanding only and no unnecessary limitations should be understood therefrom as modifications will be obvious to those skilled in the art.

What is claimed is:

1. A folder in a printing press, comprising:

a folding blade mounted to a folding blade shaft;

a folding blade shaft gear mounted to the folding blade shaft for driving the folding blade;

a drive gear for driving the folding blade shaft gear;

coupling means for coupling the drive gear to the folding blade shaft gear, the coupling means including an intermediate gear;

the coupling means being slidable between a first longitudinal position and a second longitudinal position, the coupling means engaging the drive gear to the folding blade shaft gear while the coupling means is in the first longitudinal position; and means for biasing the engaging means in the first longitudinal position;

the intermediate gear meshing with the folding blade shaft gear and the drive gear to drive the folding blade shaft while the coupling means is in the first longitudinal position, and the intermediate gear being out of mesh with the drive gear to prevent the drive gear from driving the folding blade shaft gear while the coupling means is in the second longitudinal position.

2. The folder of claim 1 wherein the coupling means comprises a plunger.

3. The folder of claim 1 wherein the biasing means comprises a spring.

4. A folder in a printing press, comprising:

a folding blade mounted to a folding blade shaft;

a folding blade shaft gear mounted to the folding blade shaft for driving the folding blade;

a drive gear for driving the folding blade shaft gear;

a plunger having a pin and having an intermediate gear between the folding blade shaft gear and the drive gear;

means for normally biasing the plunger in a first longitudinal direction and means for moving the plunger in a second longitudinal direction; and cam means having a cam race comprising first and second stops for receiving said pin on said plunger;

the plunger being positioned and in a first longitudinal position by said biasing means when the pin is engaged with the first stop, and the plunger being positioned and releasably retained in a second longitudinal position when the pin is engaged with the second stop;

the intermediate gear meshing with the folding blade shaft gear and the drive gear to drive the folding blade shaft while the plunger is in the first longitudinal position, and the intermediate gear being out of mesh with the drive gear to prevent the drive gear from driving the folding blade shaft gear while the plunger is in the second longitudinal position.

5. The folder of claim 4 wherein the biasing means comprises a spring.

6. The folder of claim 4 wherein:

the drive gear has a central recess defining a pair of sets of opposed spaced teeth;

the intermediate gear has a central recess defining a pair of sets of opposed spaced teeth;

one of the sets of teeth of the drive gear is located in the central recess of the intermediate gear while the plunger is in the second longitudinal position; and one of the sets of teeth of the intermediate gear is located in the central recess of the drive gear while the plunger is in the second longitudinal position.

7. The folder of claim 4 further comprising a tang mounted on the plunger to prevent rotation of the folding blade when the plunger is in the second longitudinal position.

8. The folder of claim 4 wherein said means for moving the plunger in a second longitudinal direction comprises returning means.

9. The folder of claim 8 wherein the actuating means comprises a retractable wedge.

10. The folder of claim 8 further comprising:

an indexing ring mounted on the plunger for rotation with respect to the plunger.

11. The folder of claim 10 wherein the indexing ring is connected to the cam means, and wherein the plunger pin slidably engages the indexing ring during movement of the plunger in the second longitudinal direction to rotate the cam means with respect to the plunger.

* * * * *